US005771528A

United States Patent [19]

Nappi, Sr.

[11] Patent Number: 5,771,528

[45] Date of Patent: Jun. 30, 1998

[54] SELF-CLEANING ENTRY CARPET ASSEMBLY WITH IMPROVED ACCESS AND SHIPPING FEATURES

[76] Inventor: John J. Nappi, Sr., 80 Beckley Rd., Berlin, Conn. 06037

[21] Appl. No.: 707,436

[22] Filed: Sep. 4, 1996

[51] Int. Cl.[6] ..... A47L 23/02; E04F 19/10

[52] U.S. Cl. ..... 15/311; 15/36; 15/301

[58] Field of Search ..... 15/301, 311, 36, 15/37

[56] References Cited

U.S. PATENT DOCUMENTS

| | | | |
|---|---|---|---|
| 823,972 | 6/1906 | Richardson . | |
| 2,533,781 | 12/1950 | Fallowfield, Jr. . | |
| 2,565,894 | 8/1951 | Stotz . | |
| 2,599,049 | 6/1952 | Dollinger . | |
| 2,860,366 | 11/1958 | Kemp . | |
| 2,895,159 | 7/1959 | Ostrow . | |
| 2,953,805 | 9/1960 | Sevenich . | |
| 3,203,020 | 8/1965 | Merkel | 15/36 |
| 3,308,499 | 3/1967 | Stieger . | |
| 3,346,904 | 10/1967 | Armstrong . | |
| 3,348,252 | 10/1967 | Lightowler . | |
| 3,482,272 | 12/1969 | McLennon . | |
| 3,526,015 | 9/1970 | Nappi . | |
| 3,611,472 | 10/1971 | Kayser . | |
| 4,198,725 | 4/1980 | Trutzschler . | |
| 4,280,244 | 7/1981 | Spirig . | |
| 4,361,925 | 12/1982 | Yamamoto et al. . | |
| 4,951,345 | 8/1990 | Nappi, Sr. . | |

FOREIGN PATENT DOCUMENTS

| | | | |
|---|---|---|---|
| 764141 | 8/1967 | Canada | 15/36 |
| 54222 | 2/1948 | France | 15/311 |
| 2452909 | 12/1980 | France | 15/36 |
| 413149 | 4/1941 | Italy | 15/36 |

*Primary Examiner*—Chris K. Moore
*Attorney, Agent, or Firm*—Perman & Green, LLP

[57] ABSTRACT

An assembly for removing debris from the feet of persons and having the capability of cleaning the collected debris, comprises a housing extending along a longitudinal axis thereof and ending in a first and an opposite second end. A drive roller is mounted for rotational movement at the first end of the housing and is disposed perpendicularly to the longitudinal axis. A driven roller is mounted for rotation on the second end of the housing and is disposed perpendicularly to the longitudinal axis thereof. A means is associated with the driven roller and the housing second end for slide in connection and slide out removal of the driven roller with the housing. An endless loop carpet is trained about each of the drive and driven rollers and extends in a direction parallel to the longitudinal axis, the endless loop carpet having an upper run and a lower run, the upper run being supported substantially by an upper plate supported by the housing. Tensioning means is associated with the driven roller for causing tension in the endless loop carpet such that upon release of pressure on the endless loop carpet applied by the tensioning means, the driven roller may be slidingly removed.

24 Claims, 9 Drawing Sheets

SELF-CLEANING ENTRY CARPET ASSEMBLY WITH IMPROVED ACCESS AND SHIPPING FEATURES

BACKGROUND OF THE INVENTION

The present invention relates to entry rug cleaning assemblies which remove loose soil from soles of shoes of persons passing thereover and in which assemblies a rug is used with the surface of the rug being cleaned periodically, and relates more particularly to improvements in such entry assemblies whereby the assemblies are made to effect ease of repair, reduction of cost in fabrication and in shipping.

In Applicant's prior U.S. Pat. No. 4,951,345 there is disclosed a rug entry cleaning mechanism which has enjoyed commercial acceptance and which has proven quite useful in the cleaning of feet of persons passing into a building. As disclosed therein a rug is mounted to the mechanism so that it may be rotated about a closed loop, and within an adjacent housing disposed below the traffic surface are vacuum and washing installations for cleaning a section of the surface of the rug which passes thereover.

Such prior art assemblies have enjoyed significant commercial success. Certain features of the these assemblies have however met with some drawbacks. First, the apparatus as shown in U.S. Pat. No. 4,951,345 employs a portion of the endless loop rug which was directed around a tensioning mechanism which was capable of being moved outwardly or inwardly depending upon the amount of tension required for the endless loop rug. This type of tensioning mechanism caused the assembly to have an increased depth to account for the tensioning loop and hence an increased weight, cost and on-site installation associated with a mechanism of this type. Additionally, a further factor to be considered and the installation of such self-cleaning rug assemblies is the ease of shipping the assembly on-site. The rug cleaning mechanisms can range anywhere between 6 feet and up in length and therefore it is preferable to crate the device in an enclosure which is more manageable to handle as opposed to one which has a length of 6 or 8 feet. Also, it is desirable to maintain the depth of the assembly at a manageable dimension so that shipping of the product is further made easier by the reduce depth of the assembly as well as reducing the on-site excavation work which is required to effect installation.

In addition, it is desirable to have an assembly in which access to the working parts is made easier such that an assembly which is broken can be repaired in, for example, on half hours time.

Accordingly, it is an object of the present invention to provide a self-cleaning entry carpet assembly wherein the assembly is made more compact relative to those assemblies hitherto known thereby providing ease of installation, repair and shipping for the manufacturer and/or user.

Still a further object of the invention is to provide an apparatus of the aforementioned type whereby the assembly includes a construction allowing ease of access to internal component parts despite being enclosed by the upwardly disposed carpet surface responsible for collecting debris from the soles of shoes or the like, of people.

Yet a further object of the invention is to provide an assembly of the aforementioned type which is automated such that a carpet surface is cleaned at routine intervals by a controller which activates an advancement and cleaning sequence responsible for the cleaning and the removal of particulates from the rug.

Other objects and advantages of the present invention will become apparent from the following specification and the appended claims.

SUMMARY OF THE INVENTION

Figure 1:
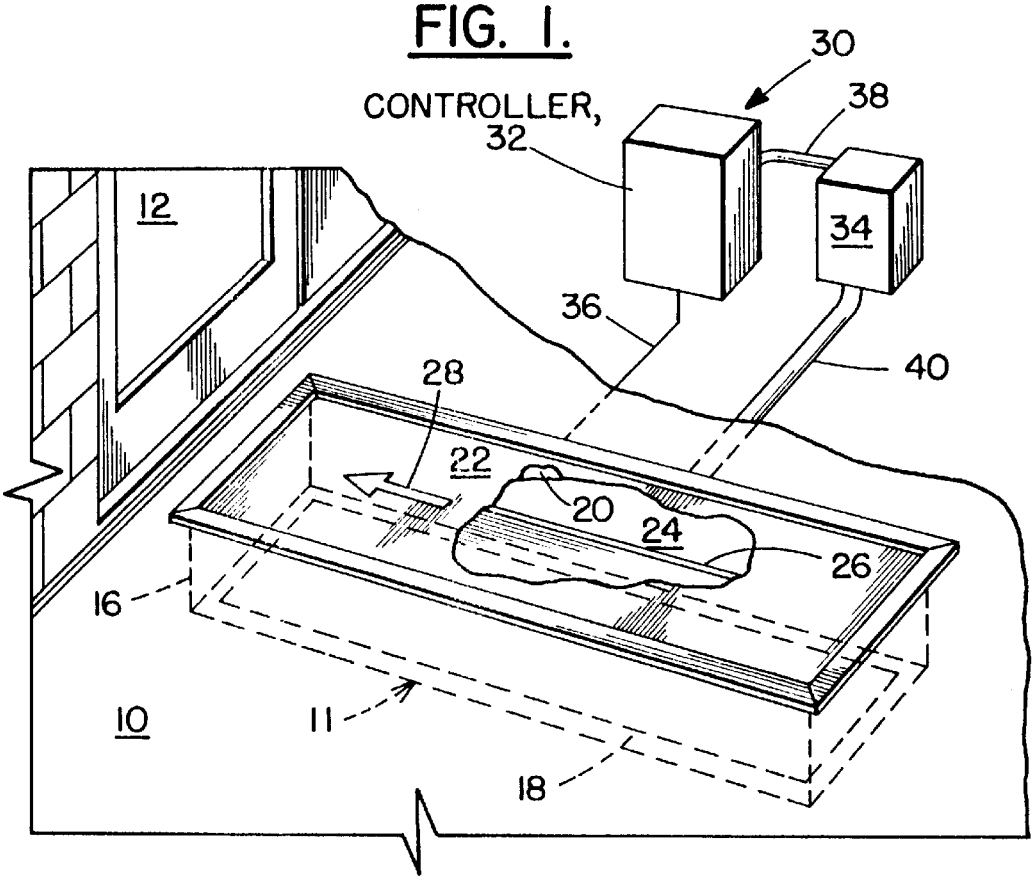
FIG. 1 is a fragmentary perspective view of an entry carpet installation embodying the present invention located adjacent an entry door with a portion of the rub and belt broken away to show the underlying support surface.

An assembly for removing debris from the feet of persons and having the capability of cleaning the collected debris, comprises a housing extending along a longitudinal axis thereof and ending in a first and an opposite second end.

A drive roller is mounted for rotational movement at the first end of the housing and is disposed perpendicularly to the longitudinal axis. A driven roller is mounted for rotation on the second end of the housing and is disposed perpendicularly to the longitudinal axis thereof. A means is associated with the driven roller and the housing second end for slide in connection and slide out removal of the driven roller with the housing. An endless loop carpet is trained about each of the drive and driven rollers and extends in a direction parallel to the longitudinal axis, the endless loop carpet having an upper run and a lower run, the upper run being supported substantially by an upper plate supported by the housing. Tensioning means is associated with the driven roller for causing tension in the endless loop carpet such that upon release of pressure on the endless loop carpet applied by the tensioning means, the driven roller may be slidingly removed.

Ideally, the upper plate being formed from two plate sections which are supported by the housing along lateral side edges thereof and wherein the upper plate sections have complimentarily shaped surfaces which are juxtaposed to one another.

Preferably, the housing includes two parallel spaced sidewalls extending parallel to the longitudinal axis thereof, and wherein the sidewalls include a laterally extending flange member at the top end thereof in which is formed a rectangular slot-like opening communicating with a generally L-shaped opening formed in each sidewall adjacent the second end thereof. The generally L-shaped opening has a vertically extending portion which communicates with the generally rectangular shaped opening formed in the laterally extending flange member and a generally horizontally extending portion extending toward the housing second end.

In the preferred embodiment, the tensioning means includes a pusher bar which extends transversely of the longitudinal axis, the pusher bar is of a length sufficient to connect at opposite ends thereof to pivot arms which are pivotably attached to each sidewall of the housing for driving the driven roller in the direction of the second housing end to effect tensioning of the carpet loop.

Ideally, the pivot arms at the free ends thereof include a pusher member and the driven roller includes a shaft member on which the driven roller is rotatably mounted extending from opposite ends thereof to which shaft member is mounted a journaling block, with each of the journaling blocks mounting to the shaft member at a spaced distance from the driven roller. Each of the journaling blocks is spaced from respective ends of the drive roller by a distance of at least the thickness of the corresponding sidewall.

Preferably, the pusher bar extends through each of the sidewalls through an arcuate shaped opening formed therein and the pusher member connecting to each of the pivot arms as measured from the outer surface of the sidewalls a distance approximately equal to the thickness of the journaling blocks.

Desirably, located intermediate the drive and driven rollers is a cleaning means for engaging with the lower run of the carpet loop to clean from the carpet debris lodged therein. The cleaning means includes a generally cylindric brush housing having a longitudinal slit formed at the top end thereof, the brush housing including end plates which the beater brush is rotatably eccentrically mounted, and wherein the housing includes a longitudinally extending slot exposing the beater brush at the top end thereof for engagement with the lower run of the carpet loop.

The brush housing may include a vacuum manifold which communicates with the brush housing through an opening formed in the lower part thereof. The brush housing having a length which is longer than the length of the manifold.

In the preferred embodiment, the assembly housing sidewalls have aligned openings formed therein for receiving end portions of the brush housing; and the manifold is secured to the lower end the brush housing to surround the lower opening formed therein and leave uncovered distal end portions of the brush housing.

The brush housing ideally includes a locating plate disposed along either side edge of the longitudinally oriented slot for supporting the lower run of the endless carpet loop in a linear fashion. The cleaning means may include a housing having two rotating brushes and being pivotally connected to the housing at the base thereof and articulated between the first position wherein one of the brushes is brought into engagement with the lower run of the carpet loop and a second position wherein the second brush is brought into engagement with the carpet loop.

Preferably, the assembly includes a removable end plate having a cantilevered portion thereof which extends inwardly into the assembly in the direction of the longitudinal axis to partially cover the portion the respective one of the drive and driven rollers which is juxtaposed to it.

In one form of the invention, the housing is formed from a plurality of self-supporting housing units which are connected to one another by frame members extending parallel to the longitudinal axis of the assembly. Each of the housing units includes an opposed pair of upstanding sidewalls and a base plate interconnected to one another by one of the frame members. Each of the housing units includes a transversely extending bar which interconnects the opposed sidewalls with one another.

The assembly may also include an opening formed in a base plate of the assembly having the cleaning means, the opening in the base plate communicating with an elbow conduit capable of swiveling 360°.

Ideally, the assembly is part of an installation wherein a generally Z-shaped outer casing i s engaged with the surrounding environment and is connected to the assembly through a bolt connection secured within material making up the installation environment. The assembly in the installation is supported on mounting plates having leveling means for effecting leveling of the assembly in the installation.

DETAILED DESCRIPTION OF THE PREFERRED EMBODIMENT

Turning first to FIG. 1, therein illustrated is an entry rug installation or assembly 2 embodying the present invention as placed in the walk 10 adjacent the entry door 12 preferably within a vestibule space of a building. The installation has an outer Z-shaped casing generally designated by the numeral 11 seated in a recess 16 in the walk 10. The outer casing 11 includes an inwardly directed lower flange 18 which underlies the installation and seals the assembly from debris which otherwise might be introduced into the interior confines thereof. Mounted in the installation for rotation is an endless belt 20 to which is secured an endless rug or carpet 22. Supporting the belt 20 is a support surface provided by an upper plate 24 with a groove 26 extending longitudinally along the center of its upper surface. The groove 26 receives a correspondingly shaped elongated projection 27 formed along the bottom surface of the belt 20 to center the carpet on the support surface 24. The arrow 28 indicates the direction of rotation of the belt 20 and the rug 22. There is also illustrated a control unit 30 which is desirably placed in a suitable enclosure adjacent the installation 2. As seen, the control unit 30 includes a controller 32 and a vacuum/washing fluid and pump unit 34. The controller connects both to the appropriate drive motors in the installation through a line 36 as well as connecting to the cleaning unit 34 through lines 38 for the purpose of controlling the on and off functions thereof. While not shown in detail the cleaning unit 34 includes a vacuum and washer unit for supplying the cleaning means of the assembly 2 with cleaning fluid and vacuum to carry away the removed debris. A conduit 40 extends outwardly thereof and encloses a vacuum line connected to the installation in a manner which will be discussed in greater detail with respect to FIG. 12. Also, while not shown separately, a small diameter fluid line is also disposed within the conduit 40 and connects to a pump and washing fluid container disposed within the cleaning unit 34 and connects to the assembly 2 to provide sprayed washing fluid to the rug on the instruction of the controller 32. The conduit 40 and the washing fluid supply line along with the control cable 36 which supplies power to the drive motors in the installation are located in a subsurface access duct (not shown) which connects to the assembly 2.

Figure 2:
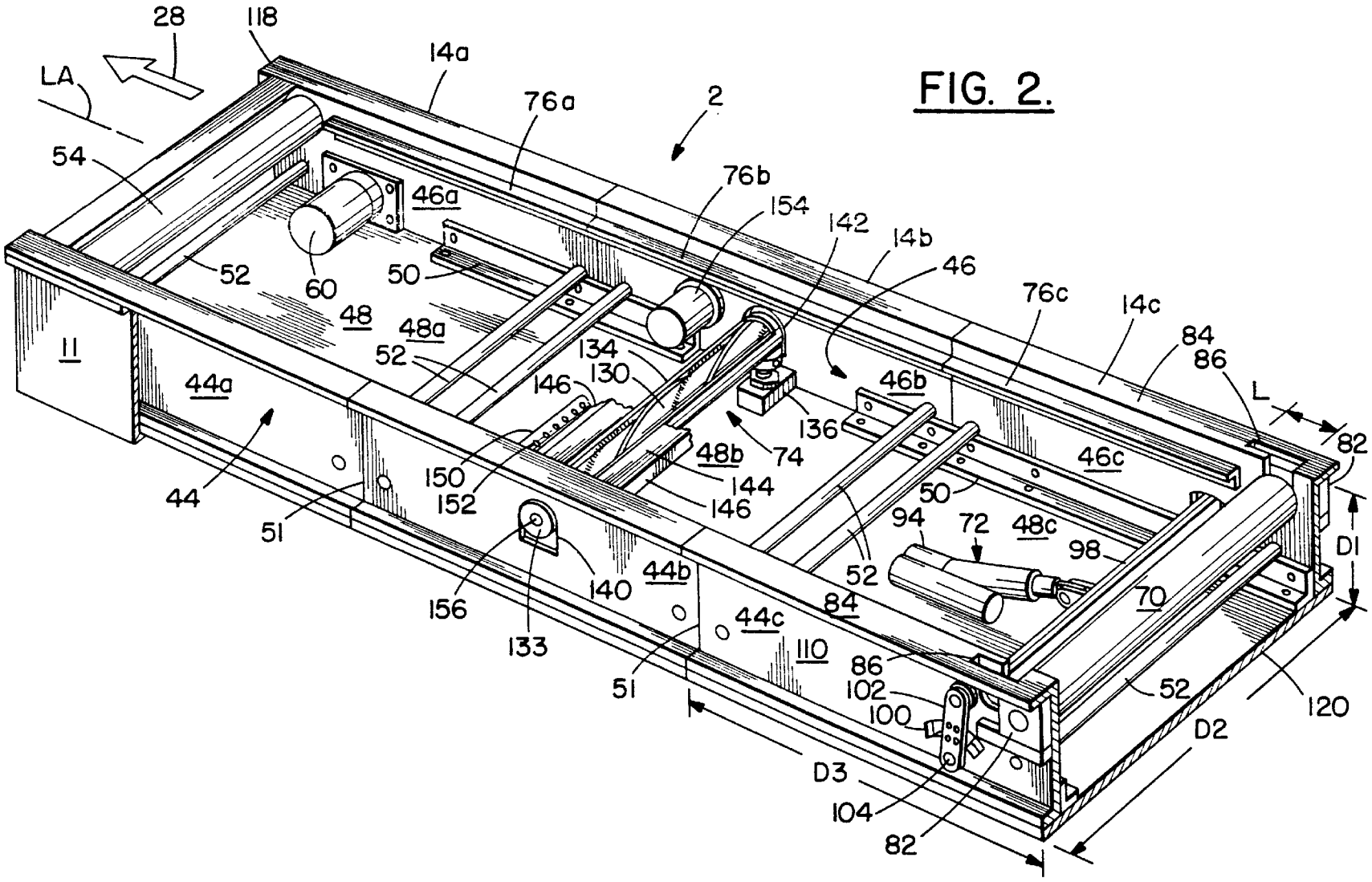
FIG. 2 is a partially fragmentary perspective view of the assembly of the present invention shown absent the rug support surface and the rug.
Figure 3:
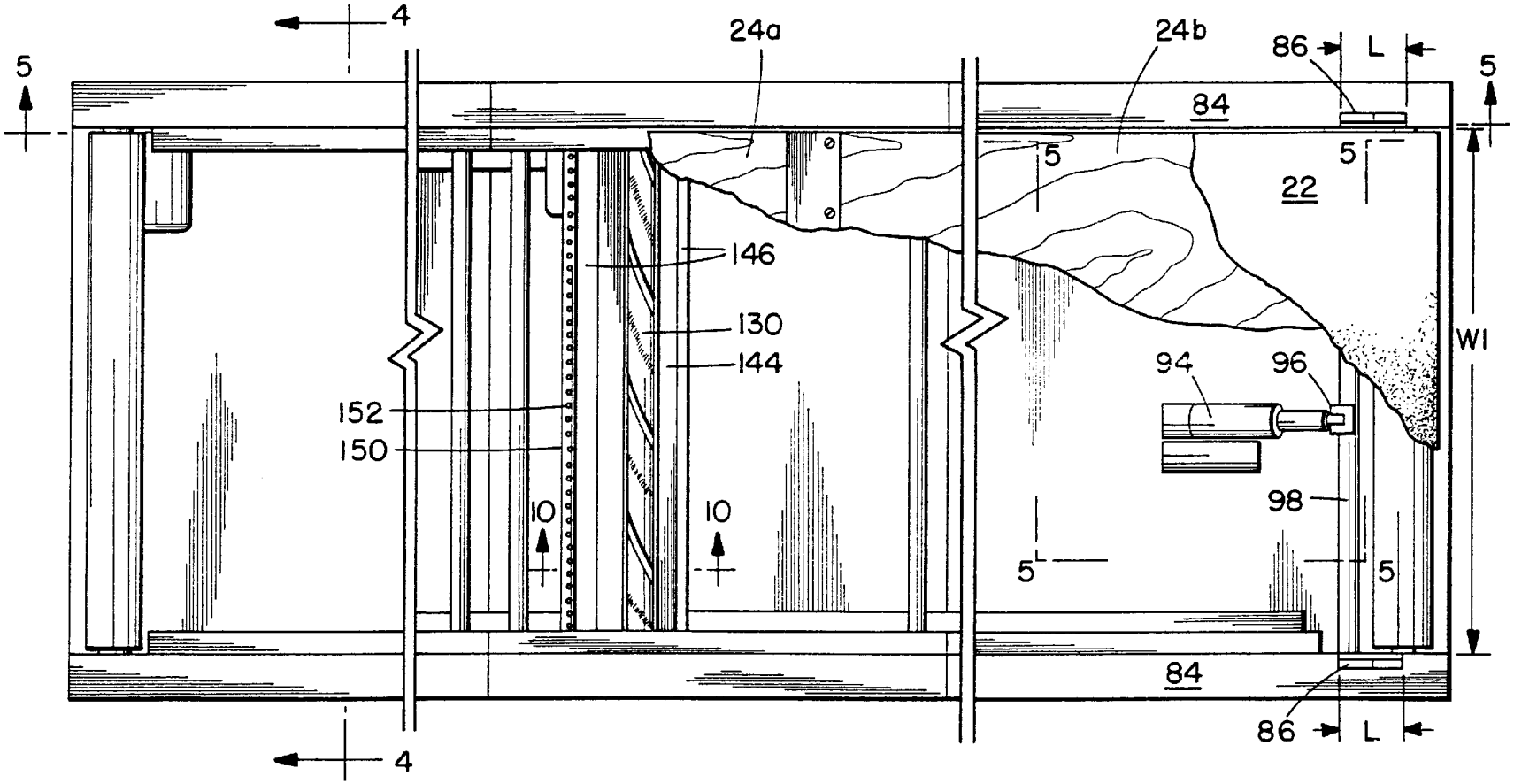
FIG. 3 is a top plan view of the assembly as illustrated in FIG. 2.

Turning now to FIGS. 2–8, the assembly 2 includes a rigid housing 14 which takes the form of a rectangular shallow box with opposed side walls 44 and 46 and a bottom wall 48 which are connected to one another at generally perpendicular dispositions by L-shaped angle irons 50,50 which secure side regions of the bottom wall 48 to a juxtaposed region of each side wall 44 and 46. As can be seen in FIG. 2, the angle irons 50,50 not only serve to connect the side walls 44 and 46 to the bottom wall 48 in a perpendicular relationship, but further serve to connect individual housing units of the assembly 2 to one another. That is, the housing 14 is made up of a plurality of stand alone units 14*a*, 14*b*, and 14*c* with the side wall 44 being comprised of three separate sections or units namely, sections 44*a*, 44*b* and 44*c* and with sidewall 46 being likewise comprised of sections 46*a*, 46*b* and 46*c*. Each of these sections corresponds to an associated section of the bottom wall 48 as illustrated by sections 48*a*, 48*b* and 48*c*. As illustrated, each angle iron 50 spans the separation line 51 between corresponding housing unit sections, e.g. 14*a* and 14*b* and 14*b* and 14*c*, so as to connect these housing unit sections to one another in a common plane and in alignment with the longitudinal axis LA of the assembly to create a rigid unit capable of supporting the rug 22 and the loads imposed thereon in a rigid manner. In the illustrated example, the assembly 2 has a depth D1 equal to about 8", a width D2 equal to about 36", and each of the sections 48*a*, 48*b* and 48*c* having an individual length D3 of about 33.6", giving the assembly 2 a total length of about 101". It should be appreciated that the dimension D1 is thus substantially shallow relative to the aggregate of lengths D3, thus requiring less on-site excavation than structure which were heretofore used.

The housing self-supporting units 14*a*, 14*b* and 14*c* are maintained rigidly as individual box-like structures through the intermediary of rigidizing bars 52, 52 which extend transversely of the longitudinal axis LA and are secured to the sidewalls 44*a*, 44*b* and 44*c* at one end thereof and to the opposing corresponding side walls 46*a*, 46*b* and 46*c* at the other opposite end thereof.

Figure 13:
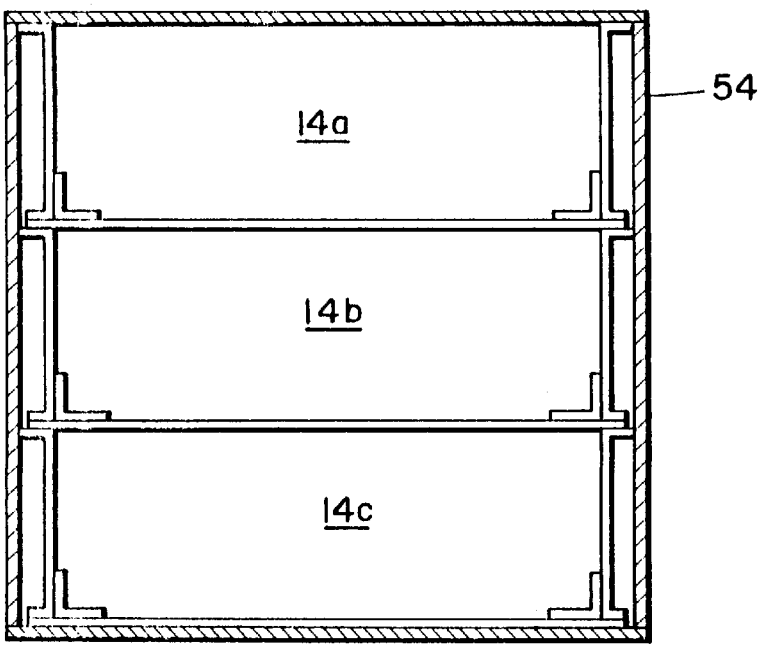
FIG. 13 is a vertical sectional view showing the assembly of the present invention in the schematic form and in an disassembled condition within a crate for shipping.

As illustrated in FIG. 13 the housing units 14*a*, 14*b* and 14*c* are identical in size and length, themselves lending to being readily stacked one on top of the other in the illustrated manner so as to be encased by a crate or like packaging container 54.

Referring now to FIGS. 2, 3, 4 and 5, it should be seen that the assembly 2 includes a plurality of components which allow the rug 22 to be supported in the manner illustrated in FIG. 1 even with the grade or walking surface 10, while further allowing the carpet to be advanced so as to effect segment by segment cleaning thereof. For this purpose, the assembly 2 includes a drive roller 54 disposed at the first end 118 thereof which is drivingly rotatably mounted to the assembly at sidewalls 44*a* and 46*a* through a conventional journaling means. The drive roller 54 is non-rotatably connected to a drive shaft 56 which extends concentrically with it and outwardly at opposite ends thereof to be received within correspondingly-shaped journaling openings formed in the sidewalls 44*a* and 46*a* of the housing 14. The drive shaft 56 has a length which extends outwardly of the roller 54 and through the wall 46 so as to provide a surface on which a drive pulley 58 is non-rotatably mounted. Mounted to the sidewall 46*a* is a drive motor 60 which has a drive shaft extending through the sidewall 46*a* and in alignment with the drive pulley 58. A smaller diameter drive pulley 62 is mounted to the drive shaft of the motor 60 and is drivingly coupled to the drive pulley 58 of the shaft 54 through the intermediary of a notched drive belt 64.

At the other opposite end 120 of the assembly 2 is a freely rotatable driven roller 70 which is removably mounted to the end walls 44*c* and 46*c* in accordance with one aspect of the invention which will hereinafter be described in greater detail. Associated with the driven roller 70 is a tensioning means 72 which is secured against movement to the bottom plate 84*c* of the assembly and is caused to coact with the driven roller 70 to deliver the appropriate tension to the rug 22. Disposed intermediately of the drive roller 54 and the driven roller 70 is a cleaning means 74 provided for the purpose of beating the fabric of the rug while simultaneously vacuuming the rug as it is beaten and applying a solution for cleaning the rug as it is advanced in the endless loop in the indicated direction 28. Disposed along the top ends of each of the side walls 46*a*,46*b*,46*c* and 44*a*,44*b*,44*c* on the interior surface thereof is a support bracket 76*a*, 76*b* and 76*c*, each of which is disposed in a common plane with the other slightly below the tops of the drive roller and the driven roller 70. In this way, the support brackets 76*a*–76*c* support the top plate 24 such that the upper surface 78 thereof lies coextensively and tangent to the top of each of the drive roller 54 and the driven roller 70.

Figure 4:
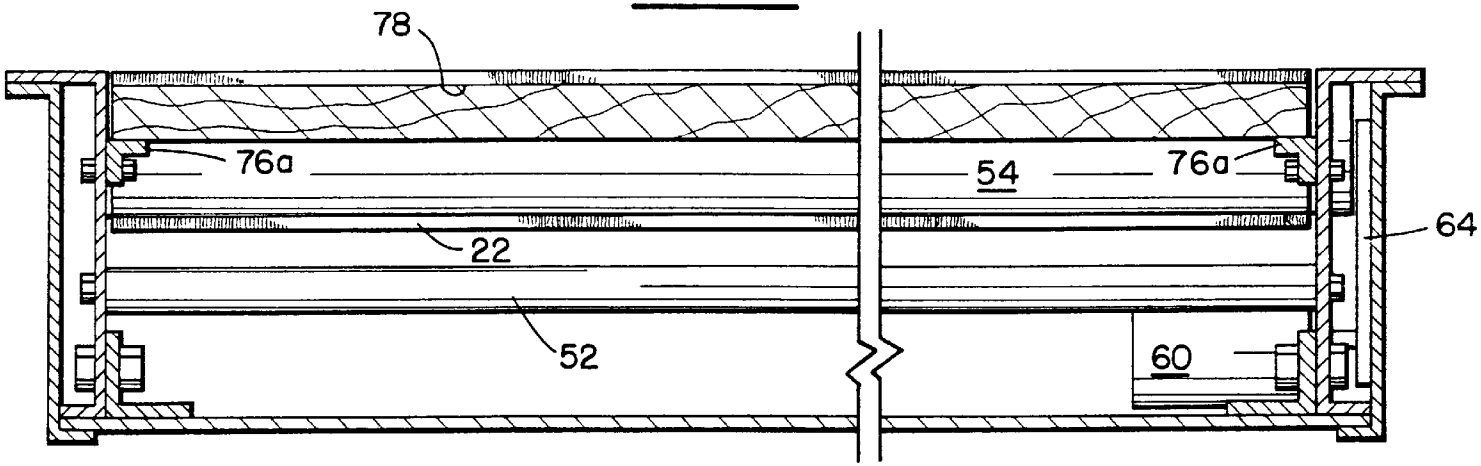
FIG. 4 is a partially fragmentary vertical section taken along line 4—4 of FIG. 3.

As illustrated in FIG. 4, the ends of the upper plate 24 which are juxtaposed relative to the rollers 54 and 70 are configured at points 80, 82 to provide a curved formed surface which is configured to follow the cylindric surface of the rollers so as to provide a support surface which as completely as possible underlies the carpet 22 to support it under the applied downward forces which are directed to it.

Figure 9A:
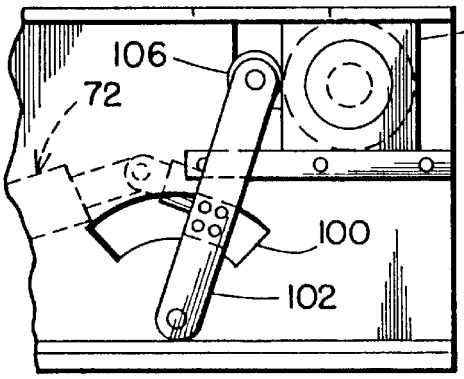
FIG. 9*a* is a partially fragmentary schematic view of the rug tensioning mechanism shown in a locking condition.
Figure 9B:
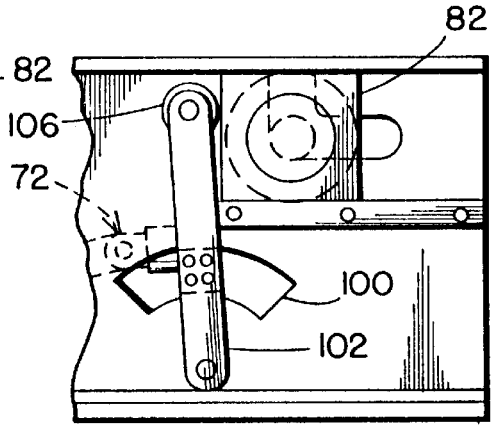
FIG. 9*b* is a partially fragmentary schematic view of the rug loop locking device shown in an unlocked condition but with the rug loop still contained within the assembly.
Figure 9C:
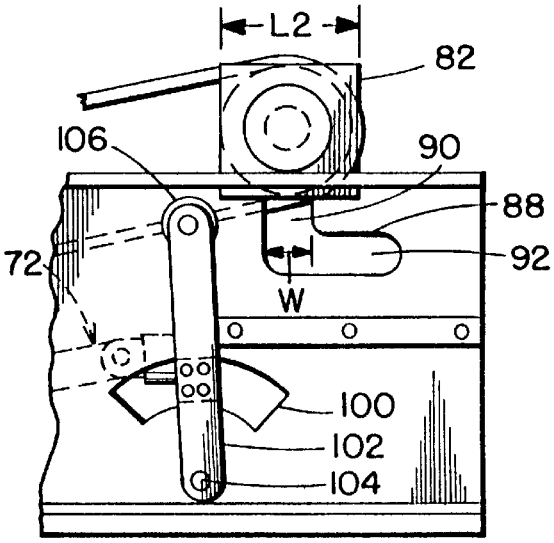
FIG. 9*c* is a partially fragmentary schematic view of the rug loop tensioning device as shown in an unlocked condition to allow removal of the associated end roller.
Figure 8:
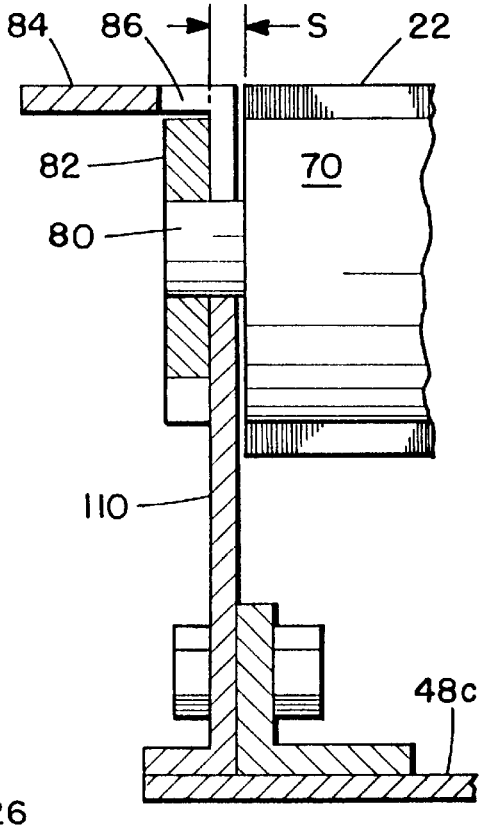
FIG. 8 is a partially fragmentary vertical sectional view taken along line 8—8 in FIG. 7.

Referring now to FIGS. 8 and 9*a*–9*c*, and to the driven roller 70 and the tensioning means 72 associated with it, it should be seen that the driven roller 70 is rotatably mounted about a central shaft 80, 80 whose ends extend outwardly of the ends of the roller 70 to provide stems about which a journaling block 82 is mounted. As best illustrated in FIG. 8, each journaling block 82 is non-rotatably secured to the shaft 88 at a spaced distance S which distance S is slightly greater than the thickness of the walls 44*c* and 46*c*. As is seen in FIGS. 2, 7*a* and 9*a*–9*c*, each of the side walls 44*c* and 46*c* has a top flange 84 which is outwardly directed therefrom. Within the flanges 84, 84 are formed a rectangular slot 86 which extends parallel to the longitudinal axis LA of the assembly 2. The slots 86 have a length L as measured along the longitudinal axis LA only slightly longer than the length L2 of the journaling blocks 82. Communicating with the rectangular slots 86 is a generally L-shaped slot 88 having a vertically extending portion 90 and an orthogonally oriented portion 92 extending parallel with the longitudinal axis LA of the assembly. The width W of the slot 88 is slightly larger than the diameter of the shaft 80 so as to slidingly receive it therewithin. Thus, it should be understood that the driven roller 70 is rotatably journaled within the assembly 2 at the housing section 14*c* by aligning the journaling block in a squared-up relationship to the top flange 84 as illustrated in FIG. 9*c* and thereafter inserting the journaling block downwardly through the rectangular slots 86, 86 such that the journaling block 82 and the roller 70 are separated by the thickness of each of the sidewalls 44*c* and 46*c* in the manner illustrated in FIG. 8 as the shaft 80 is received within the vertically extending portion 90 of the generally L-shaped slot 88.

Referring now to the tensioning means 72, it should be seen that the tensioning means 72 includes a standard powered lead screw mechanism 94 which has a first end secured against movement to the base plate 84*c* and a second movable end defined by a pivot connection 96, which is turn connected to a pusher bar 98. The pusher bar 98 extends transversely across the assembly 2 and has a length slightly greater than the width W1 thereof as defined by the opposed sidewalls 44*c* and 46*c*. As illustrated, the pusher bar 98 extends through arcuate shaped openings 100, 100 which are formed in a mirror image type fashion in each of the sidewalls 44*c* and 46*c*. The ends of the pusher bar 98 upon passing through the arcuate openings 100, 100 are attached to pivotable arm members 102, 102 which are pivotably secured to the side walls 44*c* and 46*c* through the intermediary of a pivot pin 104. Each of the pivot arms 102 is connected at the pivot pin 104 to respective ones of the sidewalls 44*c* and 46*c* in a spaced relationship therefrom. That is, the pusher bar 98 extends laterally outwardly of the respective ones of the sidewalls 44*c* and 46*c* enough to slightly extend beyond each of the journaling blocks 82, 82 so that as each pivot arm 102 may be articulated through the arcuate openings 100—100 without interference therefrom. At the free end of each of the pivot arms 102,102 is disposed a pusher member 106 which has a width measured perpendicularly to the longitudinal axis LA of the assembly substantially equal to the width of the journaling blocks 82. Each pusher member 106 is secured to the inner face of the respective pivot member 102 so as to move in close proximity of the outer surface 110 of the sidewalls 44*c* and 46*c*.

In this regard, the pusher members 106,106 acting in conjunction with the extending movement of the tensioning means 72 in the direction of the advancement arrow 28 are caused to lock the driven roller 70 from removal in the assembly 2 as well as causing the rug loop 22 to be maintained in the proper tension. That is, as best illustrated in FIGS. 9*a*–9*c*, the driven roller 70 with the endless loop rug 22 maintained around it can be readily removed or inserted into the assembly 2 by the following process. First the tensioning means 72 is activated so as to retract it from an otherwise extended condition to a position whereby it clears the opening 88 formed in the sidewalls 44*c* and 46*c* as illustrated in FIG. 9*c*. Thereafter, the driven roller 70 is positioned over the rectangular slot like openings 86 in the flanges 84 such that the shaft 80 of the roller 70 is in registry with the vertically extending portion 90 of the L shaped opening 88. Thereafter the journaling blocks 82 are lowered into the openings 86,86 which are dimensioned with respect to the vertically extending portion 90 of the L shaped opening 88 so as to automatically locate the shaft 80 therewithin. The shaft 80 is then caused to sit at the bottom of the L shaped opening 88 in the manner shown in FIG. 9*c*. Thereafter the tensioning means 72 is caused to be energized to move the pusher bar 98 to an extended position. In so doing, the pusher bar 98 simultaneously advances each of the pivot arms 102 in a clockwise direction, and in turn advances the pusher members 106 into engagement with the journaling blocks 82 to advance the shaft 80 of the driven roller 70 into the horizontally disposed portion 92 of the L shaped opening 88. In so doing, the driven roller 70 as it is advanced in this manner by the tensioning means 70, causes the endless loop rug 22 to be tensioned over the upper plate 24 as well as securing the driven roller 70 against pull out within the assembly 2. In this way, the driven roller 70 is further capable of quick disassembly in the event that service must be rendered to the interior confines of the assembly 2. Thus, a means is provided for slide-in connection with and a slide-out removal of the driven roller 70 with the housing 14.

Figure 5:
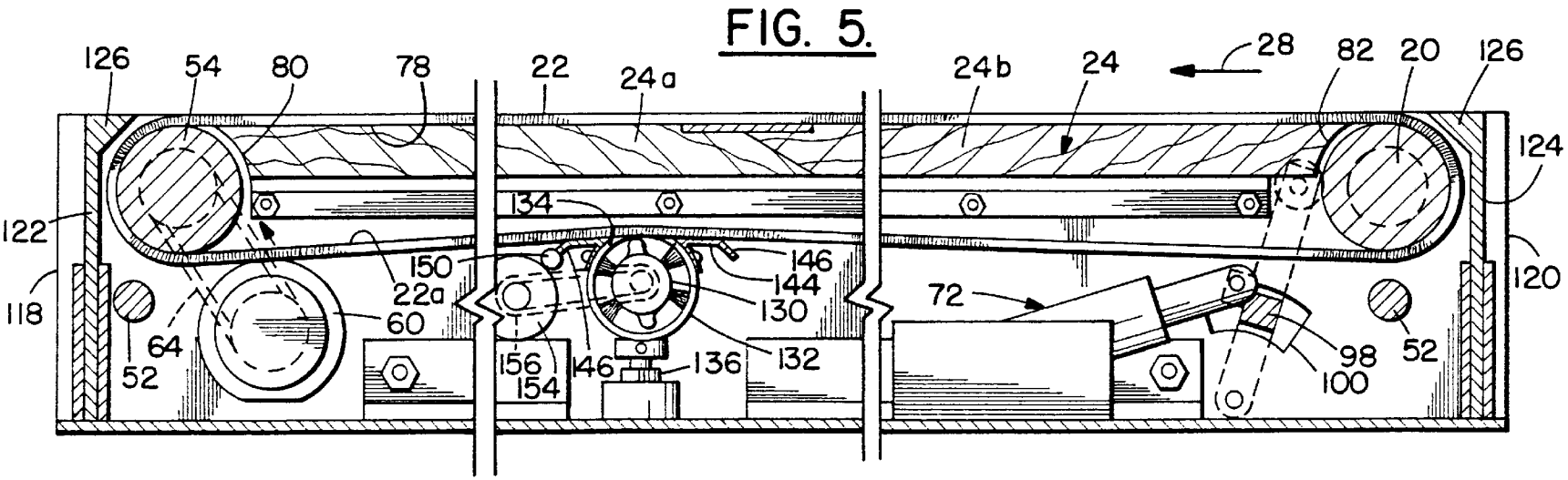
FIG. 5 is a partially fragmentary vertical sectional view of the assembly of FIG. 3 taken along line 5—5 thereof.
Figures 7A, 7B:
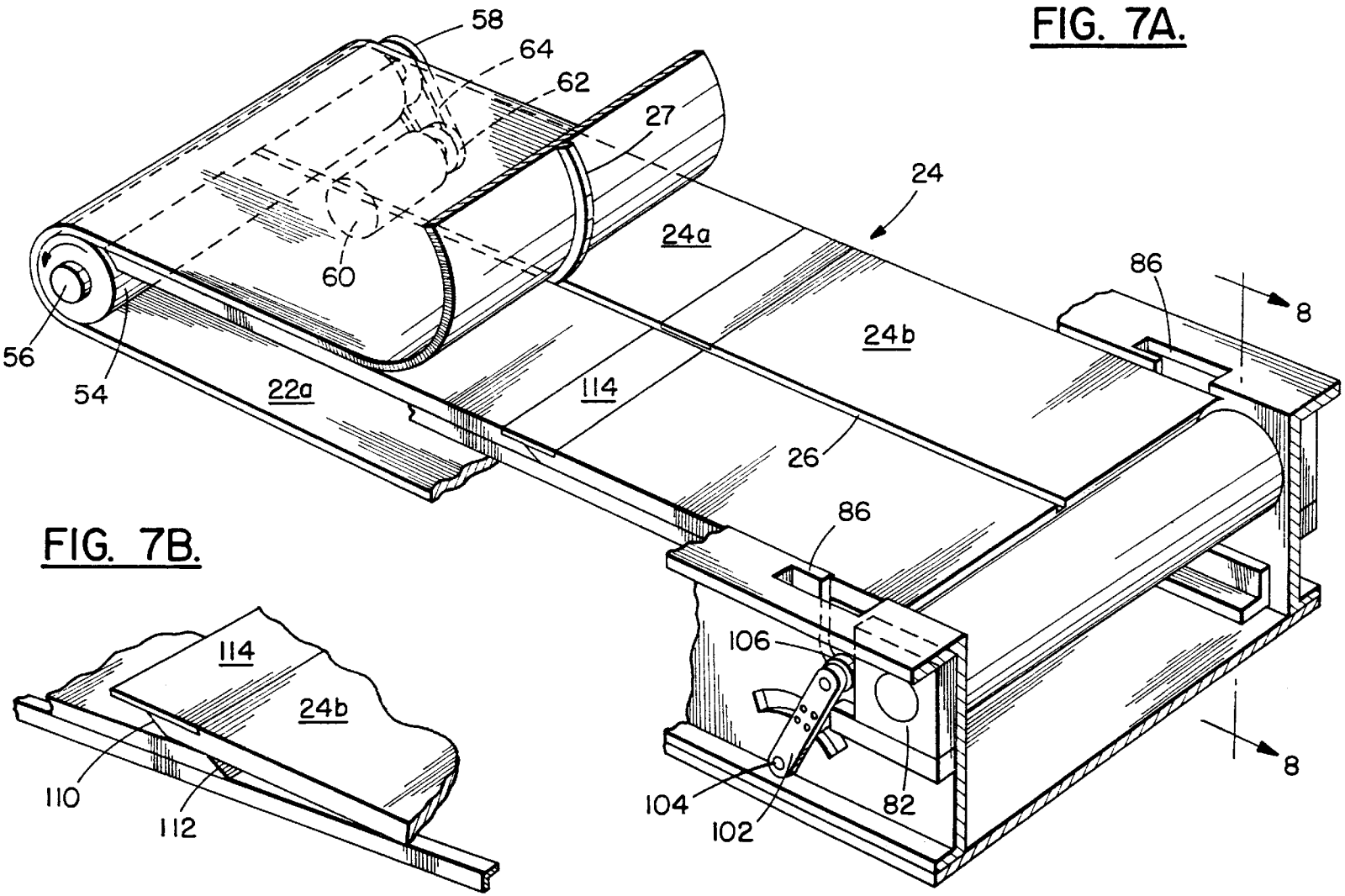
FIG. 7*a* is a fragmentary perspective view of the assembly of the present invention with the endless loop rug shown severed to reveal the underlying support surface.
FIG. 7*b* is a partially fragmentary perspective of a complimentarily-shaped abutting surfaces of the underlying support surface shown in a ramped condition.

In further keeping with the aspect of the invention which provides for quick access to the internal components of the assembly 2, it should be seen with respect to FIGS. 7*a* and 7*b* that the upper plate 24 is formed from a multiple piece construction as referenced by elements 24*a* and 24*b*. The juxtaposed ends of the plate sections 24*a* and 24*b* as best illustrated in FIG. 7*a* have corresponding inversely sloped surfaces 110 and 112 which are placed in confronting relationship with one another when the plate sections are commonly disposed on the support flanges 76*a*, 76*b* and 76*c*. An overlay plate 114 is provided on the plate section 24*b* and is secured to the free end thereof in order to cover the seam between the confronting surfaces 110 and 112 when the top plates are in the aligned relationship shown in FIG. 7*a*. The confronting inversely sloping surfaces 110 and 112 taken in conjunction with the endless loop rug 22 and the action of the tensioning means 72 cause the top plate section 24*b* to be automatically lifted when the tensioning means 72 is energized to a retracted condition as shown in FIG. 9*b*. That is, the endless loop rug 22 with its belt 20 are caused to be somewhat stretched longitudinally by the tensioning action of the tensioning means 72 when the pivot arms 102 are in the locking condition shown in FIG. 9*a*. However, in the relaxed condition of the endless rug 22, the surface of the driven roller 70 which is juxtaposed to the plate section 24*b* is drawn into engagement with the end of this plate section to cause the top plate section 24*b* to be moved in the direction 28 as illustrated in FIG. 5 and thereby ramp the section 24*b* over section 24*a* in the manner illustrated in FIG. 7*b*. It should be understood that the movement of the endless loop rug 22 in the direction 116 upon release of the pivot arms 102 to the position shown in FIG. 9*b* causes enough slack in the loop to allow for the overlapping condition of the top plates 24*a* and 24*b* as shown in FIG. 7*b*.

Figure 6:
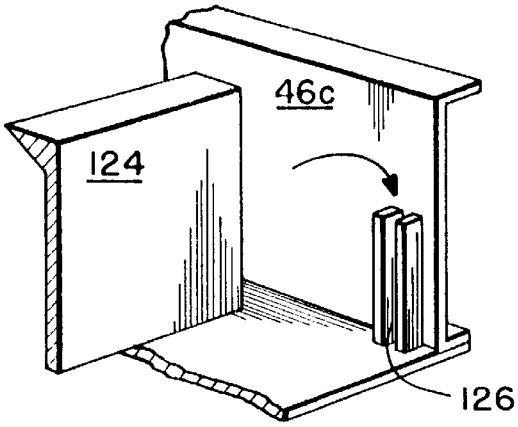
FIG. 6 is a fragmentary perspective view of one end of the assembly showing the removable end plate and associated mounting connection.

As seen in FIG. 6, in order to maintain the assembly 2 against the introduction of debris at the drive and driven ends 118 and 120, respectively, of the assembly, as well as to closely cover the top surfaces of the drive roller 54 and the driven roller 70 at these ends, end plates 122 and 124 are provided which are slidingly received within a locating slot 126 formed along the inner surfaces of the sidewalls 46*a* and 44*a* and at sidewalls 44*c* and 46*c*. Each slot 126 may take various forms, but in the preferred embodiment it is formed from two parallel spaced plates which are welded to the respective inner surfaces of the assembly sidewalls. As seen in FIG. 5, each of the end plates 122 and 124 includes a cantilevered portion 126 which overhangs the juxtaposed surface of the drive and driven rollers to present a substantially continuous support surface for walking on.

Referring now to FIGS. 2, 3, 5, 10 and 11, it should be seen that the means 74 includes a rotating beater brush 130 which is eccentrically journaled for rotation within a brush housing 132 on end plates 133,133 which cap the brush housing 132 at opposite ends thereof. The brush housing 132 has a longitudinally extending cutout 134 which exposes the circular path taken by the rotating beating brush 130 for the purpose of engagement with the lower run 22*a* of the rug 22 which is moved above it in the manner illustrated in FIG. 5.

Each longitudinal end of the brush housing 132 is supported by an adjustable amount 136 which is capable of moving the brush assembly into engagement with the lower run 22*a* of the rug. In this way, the endless loop rug 22 can be tensioned by the upward positioning of the brush assembly upon selected extension of the adjustment means 136.

The length of the brush housing 132 is selected so as to be slightly longer than the width W1 of the assembly 2 so as to be received at its free ends within end receiving openings 140 and 142 formed respectively in the sidewalls 44*b* and 46*b*. Attached to the brush housing 132 adjacent the longitudinal slot 134 formed therein and extending parallel to the lower run 22*a* of the rug is a locating plate 144 which is secured to the brush housing on opposite sides of the longitudinal slot 134. The locating plate 144 has a length which is slightly smaller in dimension than the width W1 of the assembly and therefore secures the brush housing 132 against axial movement within the end receiving openings 140 and 142. The locating plate 144 further has guide portions 146 which are provided for guiding the lower run 22*a* of the rug 22 into and out of engagement with the exposed rotating beater brush. At the upstream one of the guide portions 146 is a spray jet 150 which is secured to the guide porion 146 and has a plurality of spray nozzles 152 which are directed upwardly at the opposed surface of the lower run 22*a* of the rug. The beater brush 130 is rotatably driven by the high speed drive motor 154 which is drivingly connected to the beater brush central shaft 156 through the intermediary of a drive belt 158.

As mentioned, a spray nozzle 152 through the appropriate direction of the controller 32 to the pumps included as part of the cleaning unit 34 causes a cleaning liquid to be sprayed on the rug lower run 22*a* of the rug in advance of the rug engaging with the rotating beater brush 130. It is a further aspect of the invention to provide as part of the brush housing 132 a vacuum source for removing both debris which is mechanically removed by the rotating beater brush 130 as well as removing liquid introduced by the spray nozzles 152. For this purpose, a vacuum manifold 160 is provided and is sealingly attached to the bottom of the brush housing 132 in the manner illustrated in FIG. 10 by an appropriate adhesive such as an acrylic or the like.

Figures 11, 12:
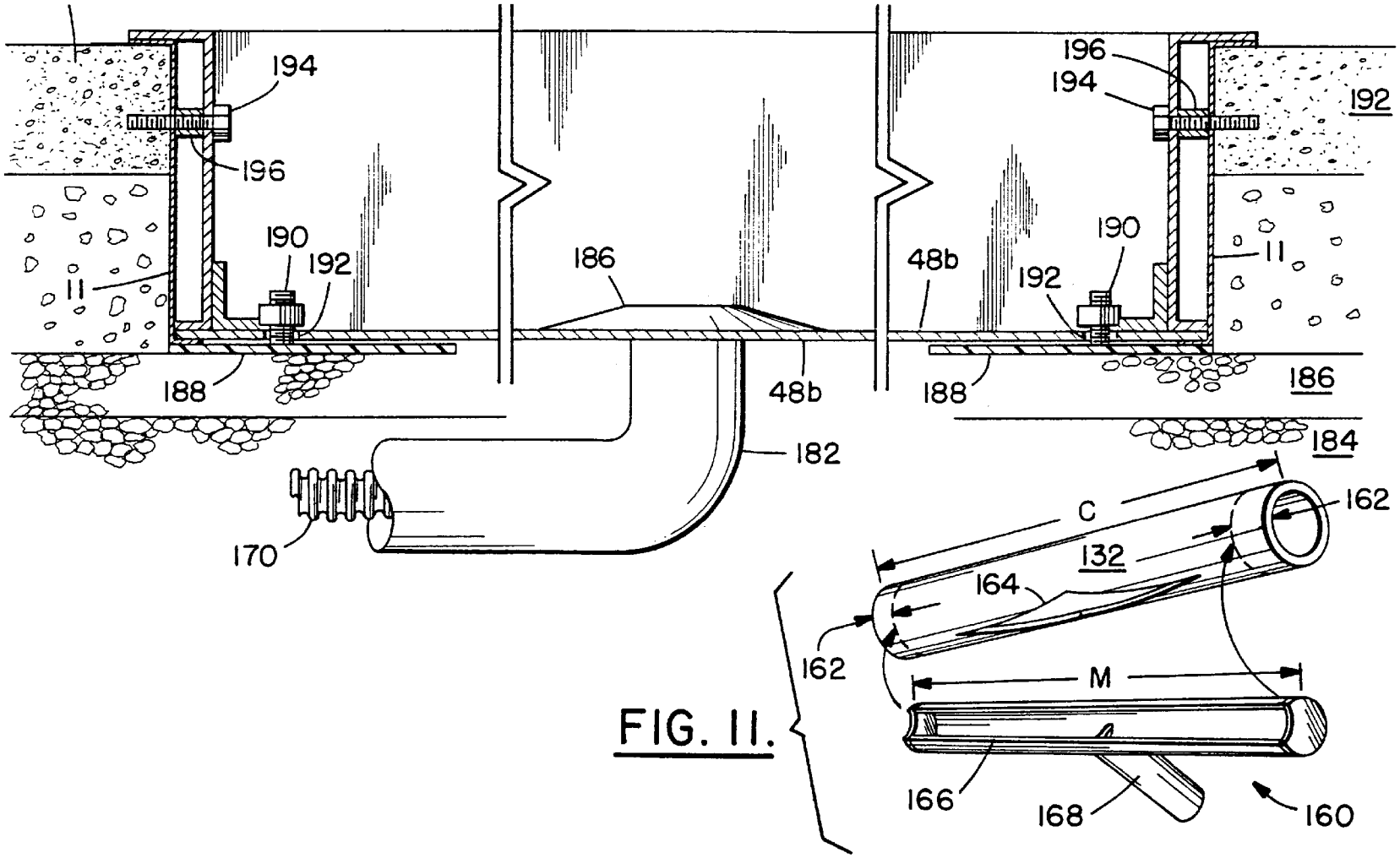
FIG. 11 is a perspective view showing schematically the cut-out formed in the bottom of the beater tube with the waste collecting manifold shown separately thereof.
FIG. 12 is a partially fragmentary vertical section through the installation of the invention of the present assembly as would be found on sight.

As illustrated in FIG. 11, the manifold 160 has a length M which is shorter than the overall length C of the brush housing 132 so as to leave exposed free end regions 162 at opposite ends of the brush housing. The regions 162 are sufficiently long in dimension to provide an exposed length of the brush housing sufficient to be received within the end openings 140 and 142, as well as to be supported by the adjustable mounts 136, 136 located in registration with the regions 162 and 162. The inner chamber of the brush housing 132 communicates with the manifold 160 through the intermediary of a diamond-shaped opening 164 which is dimensioned so as to be sealingly surrounded by the manifold ends 166. The manifold includes a connecting tube 168 which depends from it and is of a length sufficient to connect with a vacuum conduit 170 extending between the cleaning unit 134 and the assembly 2. The vacuum conduit 170 is connected to a vacuum source within the unit 34 and draws both fluid and debris therethrough.

Figure 14:
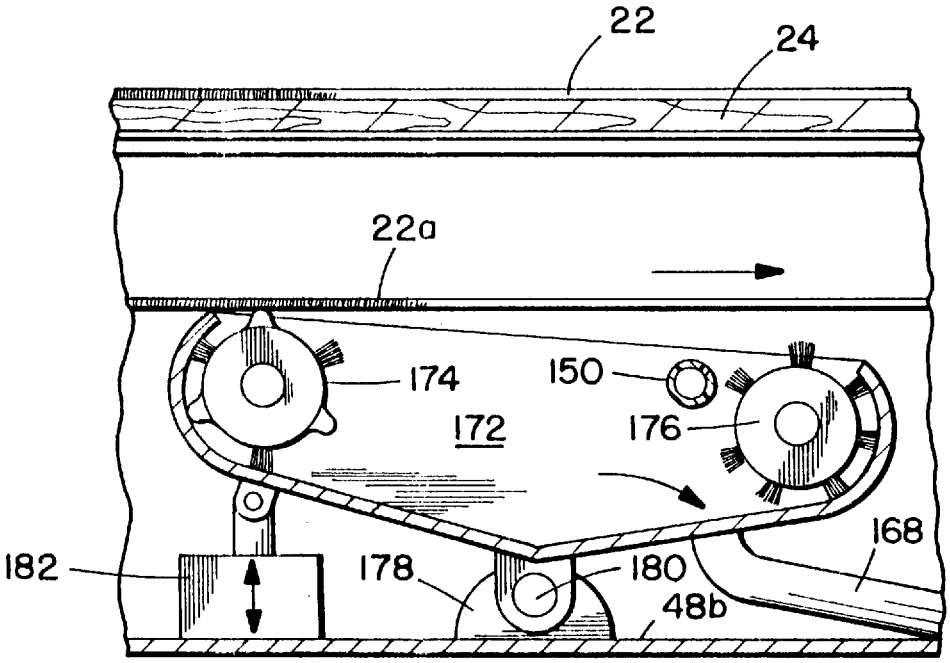
FIG. 14 is a partially fragmentary view of an alternative form of the brush assembly.

Referring now to FIG. 14 and to an alternate embodiment of beater brush assembly, it should be seen that the manifold 172 includes two rotating brushes 174 and 176 which may be commonly driven by a single drive source, such as the high speed motor 154. The housing 172 is pivotally mounted to the base plate 148*b* at a pivot connection 178 which includes a pivot pin 180. The housing 172 is further controllably pivoted about the pivot pin 180 by a vertical actuator 182 which is in turn controlled by instructions issued to it by the controller 32. The vertical actuator 182 has an extended condition corresponding to the brush 74 being moved into engagement with the rug lower run 22*a*, and a retracted condition whereby the brush 176 is moved into engagement with the lower run 22*a* of the rug 22. Communicating with the internal confines of the housing 172 is a duct 168 which similarly connects to the vacuum conduit 170 in the manner discussed above.

Figure 10:
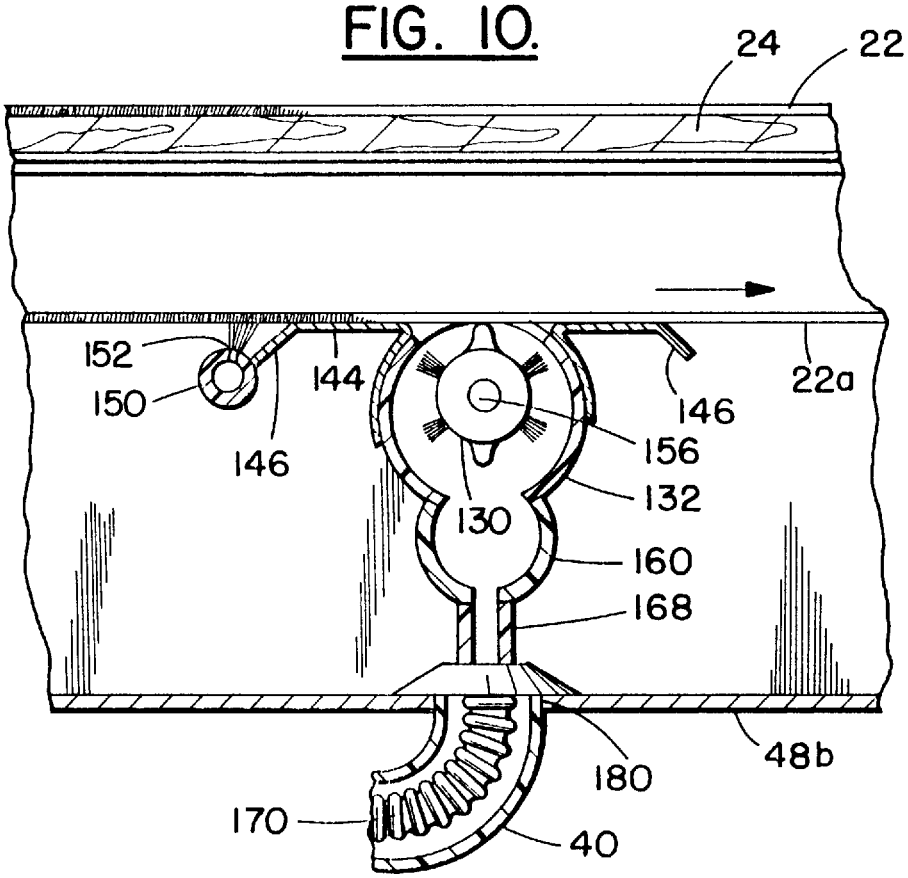
FIG. 10 is a partially fragmentary vertical sectional view taken along line 10—10 in FIG. 3.

Referring now to FIGS. 10 and 12 it should be seen that the assembly 2 is secured within the environment illustrated in FIG. 1 in accordance with a further aspect of the invention. The base plate 48*b* of the center housing section includes an opening 180 through which is disposed an elbow conduit 182. The elbow conduit 182 connects with the conduit 40 running from the unit 34 at a point remote of the assembly 2. The elbow conduit 182 further includes a flanged top portion 186 which connects to the top free end of the elbow conduit to allow the elbow conduit to swivel in a 360° manner. In this way, the conduit 182 may be directed toward the unit 34 in any direction depending upon its location. As illustrated, the assembly 2 rests on a gravel base 184 supporting a layer of sand 186 thereon. On top of the sand layer 186 or other suitable base layer making up the foundation for the assembly 2, are adjustment plates 188,188 disposed along each long longitudinal side edge of the assembly. The adjustment plates 188 include vertically extending threaded studs 190,190 which extend through openings 192,192 in the base plates 48*a*, 48*b* and 48*c*. In this way, levelling of the assembly can be effected.

Further in accordance with the invention, the assembly 2 and the outer housing 14 are connected rigidly to the pavement material 192 through the intermediary of anchoring bolts 194. The side walls 44 and 46 of the assembly are maintained rigidly spaced from the outer casing 11 by a spacer member 196 which is disposed concentrically around each of the mounting bolts 194. In this way, the assembly is secured against movement both laterally and vertically in the illustrated manner.

In operation, the control unit 30 is one which can function automatically, semi-automatically or manually to control the various elements of the assembly. In fully automatic operation, a microprocessor which is part of the control unit 30 is programmed to control rotation of the belt and cleaning operations including the rotation of the beater brush drive motor 144 in response to signals from approach sensors. A clock mechanism in the control unit controls cycles in accordance with the program provided in the microprocessor. The program may be one which permits time periods between various operations to be readily changed by operator input or alternatively the unit may be operated semi-automatically so that maintenance personnel will periodically inspect the installation and start the cleaning cycle at an appropriate time or merely change the exposed rug surface by moving the belt ½ rotation. Additionally, the controller may be programmed to count the number of walkovers and, at a given count, cause the advancement of the rug movement and cleaning operation when the set number is reached. The control unit 30 is also capable of manual operations of its various elements. Typically, the control unit has a panel with switches for each of the motors and pumps to permit manually induced operations and include indicator lights which indicate the status of various operative components.

Figure 15:
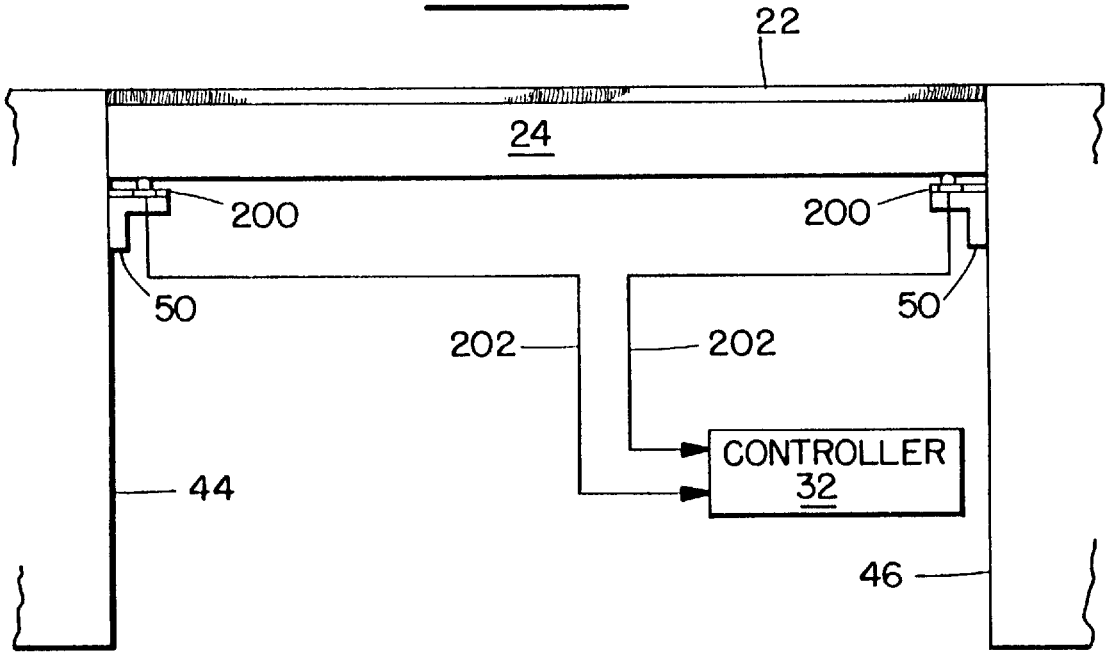
FIG. 15 is a schematic view of a carpet stop safety feature.

Also, as illustrated schematically in FIG. 15, the upper plate sections 24*a*, 24*b* may not be directly supported by the flanges or angle irons 50,50, but may instead be supported through the intermediary of a plurality of spring switches 200 which are mounted to the flanges and cause a signal to be sent to the controller 32 along lines 202 to indicate the presence of a load, e.g. child, on the carpet thereby causing the controller to prohibit carpet advancement until such time that the signal from switches 200 no longer exists. Alternatively, a safety clutch may be used at the drive motor 60.

Usually under conditions which do not involve the transport of considerable soil on the feet of persons or on the surfaces of objects which are passing over the assembly, the cleaning cycles will be about 8 hours apart. Under such conditions, the typical cleaning cycle will involve 10 to 30 minutes of operation of the beater brush to remove the bulk of the particulate contamination and followed by a washing cycle of an equivalent period. Under conditions involving the substantial soiling of the exposed surface rug, the cycle may be reduced to as little as 10 to 30 minutes static, 10 to 30 minutes of beater brush action and 10 to 30 minutes of washing action. Advancement of the rug across the beater brush is at a rate sufficient to permit cleaning which has been found in one embodiment to be about 8.5 inch per minute.

Although it is preferable that the belt and rug remain stationary during periods when persons are walking thereover, it is possible to rotate the rug at a very slow rate on the order of ½ to 1 and ½ feet per minute. This may be necessary when the conditions are such that rapid soiling has occurred, because it is not possible to conduct the cleaning operations during periods when people are not walking over the installation. Also, as the assembly 2 is adapted to be used with approach present sensors to terminate the rotation of the belt when a person is about to walk on it. This may be in the form of an electric eye, or beam interrupt unit mounted on posts on the approach walkway. Other suitable sensors would be microwave and ultrasound sensors mounted on the building adjacent entry door.

Thus it can be seen from the foregoing detailed specification and the drawings, detailed specification that the self-cleaning rug entry assembly of the present invention is one which will provide a highly desirable action of removing soil from the feet of person passing thereover while maintaining a desirable surface appearance. The installation is further one which is capable of cleaning itself and is capable of being readily disassembled while in place within the installation to accommodate quick changes and modifications to internal components. Furthermore, while in the preferred embodiment the assembly has been described in terms of three sections, it is nevertheless within the purview of the invention to provide an assembly which is of a longer length, and comprised of four or more such housing units.

Accordingly, the invention has been described by way of illustration rather than limitation.

What is claimed is:

1. An assembly comprising:

a housing extending along a longitudinal axis thereof and ending in a first and an opposite second end;

a drive roller mounted for rotational movement at said first end of said housing and being disposed perpendicularly to said longitudinal axis;

a driven roller mounted for rotation on said second end of said housing and being disposed perpendicularly to said longitudinal axis thereof;

means associated with said driven roller and said housing second end for slide in connection and slide out removal of said driven roller with said housing;

an endless loop carpet trained about each of said drive and driven rollers and extending in a direction parallel to said longitudinal axis;

said endless loop carpet having an upper run and a lower run, said upper run being supported substantially by an upper plate supported by said housing;

tensioning means associated with said driven roller for causing tension in said endless loop carpet; and wherein upon release of pressure on said endless loop carpet applied by said tensioning means, said driven roller may be slidingly removed.

2. An assembly as defined in claim 1 further characterized in that said upper plate being formed from two plate sections which are supported by said housing along lateral side edges thereof; and wherein said upper plate sections having complimentarily shaped end surfaces which are juxtaposed to one another.

3. An assembly as defined in claim 2 further characterizing in that said housing includes two parallel spaced sidewalls extending parallel to the longitudinal axis thereof; and wherein said sidewalls including a laterally extending flange member at the top end thereof in which is formed a rectangular slot-like opening communicating with a generally L-shaped opening formed in each sidewall adjacent the second end thereof.

4. An assembly as defined in claim 3 further characterized in that said generally L-shaped opening has a vertically extending portion which communicates with said generally rectangular shaped opening formed in said laterally extending flange member and a generally horizontally extending portion extending toward said housing second end.

5. An assembly as defined in claim 4 further characterized in that the tensioning means includes a pusher bar which extends transversely of said longitudinal axis;

said pusher bar being of a length sufficient to connect at opposite ends thereof to pivot arms which are pivotably attached to each sidewall of said housing for driving the driven roller in the direction of the second housing end to effect tensioning of said carpet loop.

6. An assembly as defined in claim 5 further characterized in that the pivot arms at the free ends thereof including a pusher member and said driven roller including a shaft member on which said driven roller is rotatably mounted extending from opposite ends thereof to which shaft member is mounted a journaling block;

each of said journaling blocks mounting to said shaft member at a spaced distance from said driven roller.

7. An assembly as defined in claim 6 further characterized in that each of said journaling blocks is spaced from respective ends of said drive roller by a distance of at least the thickness of the corresponding sidewall.

8. An assembly as defined in claim 7 further characterized in that said pusher bar extends through each of said sidewalls through an arcuate shaped opening formed therein and said pusher member connecting to each of said pivot arms as measured from the outer surface of said sidewalls a distance approximately equal to the thickness of said journaling blocks.

9. An assembly as defined in claim 2 further characterized in that said two plate sections which are supported by said housing along lateral side edges thereof each include an aligned groove in which rides a correspondingly shaped elongate projection formed along the bottom surface of said endless loop carpet.

10. An assembly as defined in claim 1 further characterized in that located intermediate the drive and driven rollers is a cleaning means for engaging with the lower run of said carpet loop to clean from said carpet debris lodged therein.

11. An assembly as defined in claim 10 further characterized in that said cleaning means includes a generally cylindric brush housing having a longitudinal slit formed at the top end thereof, said brush housing including end plates to which the beater brush is rotatably eccentrically mounted; and wherein said housing includes a longitudinally extending slot exposing said beater brush at the top end thereof for engagement with said lower run of said carpet loop.

12. An assembly as defined in claim 11 further characterized in that said brush housing includes a vacuum manifold which communicates with said brush housing through an opening formed in the lower part thereof; and said brush housing having a length which is longer than the length of said manifold.

13. An assembly as defined in claim 12 further characterized in that said assembly housing sidewalls have aligned openings formed therein for receiving end portions of said brush housing; and wherein said manifold is secured to the lower end the brush housing to surround said lower opening formed therein and leave uncovered distal end portions of said brush housing.

14. An assembly as defined in claim 13 further characterized by said brush housing including a locating plate disposed along either side edge of said longitudinally oriented slot for supporting the lower run of said endless carpet loop in a linear fashion.

15. An assembly as defined in claim 13 further characterized in that said cleaning means includes a housing having two rotating brushes and being pivotally connected to said housing at the base thereof and articulated between the first position wherein one of said brushes is brought into engagement with said lower run of said carpet loop and a second position wherein said second brush is brought into engagement with said carpet loop.

16. An assembly as defined in claim 13 further characterized in that each of said first and second ends of said assembly includes a removable end plate having a cantilevered portion thereof which extends inwardly into said assembly in the direction of said longitudinal axis to partially cover the portion the respective one of said drive and driven rollers which is juxtaposed to it.

17. An assembly as defined in claim 16 further characterized in that said housing is formed from a plurality of self-supporting housing units which are connected to one another by frame members extending parallel to the longitudinal axis of said assembly.

18. An assembly as defined in claim 17 further characterized in that each of said housing units includes an opposed pair of upstanding sidewalls and a base plate interconnected to one another by one of said frame members.

19. An assembly as defined in claim 18 further characterized in that each of said housing units includes a transversely extending bar which interconnects the opposed sidewalls with one another.

20. An assembly as defined in claim 19 further characterized in that said assembly includes an opening formed in a base plate of the assembly having said cleaning means, said opening in said base plate communicating with an elbow conduit capable of swiveling 360°.

21. An assembly as defined in claim 20 further characterized in that said assembly is part of an installation wherein a generally Z-shaped outer casing is engaged with the surrounding environment and is connected to the assembly through a bolt connection secured within material making up the installation environment.

22. An assembly as defined in claim 21 further characterized in said assembly in said installation is supported on mounting plates having leveling means for effecting leveling of the assembly in the installation.

23. An assembly as defined in claim 1 further characterized by said housing having a depth dimension of in the order of about 8".

24. An assembly comprising:

a housing extending along a longitudinal axis thereof and ending in a first and an opposite second end defining a length thereof;

a drive roller mounted for rotational movement at said first end of said housing and being disposed perpendicularly to said longitudinal axis;

a driven roller mounted for rotation on said second end of said housing and being disposed perpendicularly to said longitudinal axis thereof;

means associated with said driven roller and said housing second end for slide in connection and slide out removal of said driven roller with said housing;

an endless loop carpet trained about each of said drive and driven rollers and extending in a direction parallel to said longitudinal axis;

said endless loop carpet having an upper run and a lower run, said upper run being supported substantially by an upper plate supported by said housing;

tensioning means associated with said driven roller for causing tension in said endless loop carpet; and wherein said housing has a depth dimension measured perpendicularly to said length dimension which is substantially shallow relative to the length of said length dimension and said upper plate being formed from two plate sections which are supported by said housing along lateral side edges thereof and said upper plate sections having complimentarily shaped end surfaces which are juxtaposed to one another.

* * * * *